US009186595B1

(12) United States Patent
Cannon

(10) Patent No.: US 9,186,595 B1
(45) Date of Patent: Nov. 17, 2015

(54) TOY WITH PERSISTANCE OF VIEW COMPONENTS

(75) Inventor: Bruce James Cannon, El Segundo, CA (US)

(73) Assignee: MATTEL, INC., El Segundo, CA (US)

( * ) Notice: Subject to any disclaimer, the term of this patent is extended or adjusted under 35 U.S.C. 154(b) by 581 days.

(21) Appl. No.: 13/209,537

(22) Filed: Aug. 15, 2011

Related U.S. Application Data

(60) Provisional application No. 61/373,316, filed on Aug. 13, 2010.

(51) Int. Cl.
*A63H 1/24* (2006.01)
*A63H 33/22* (2006.01)
*G09G 3/00* (2006.01)

(52) U.S. Cl.
CPC ..... *A63H 33/22* (2013.01); *G09G 3/005* (2013.01)

(58) Field of Classification Search
CPC ..... A63H 33/00; A63H 33/26; A63H 1/24; A63H 33/22; G09G 3/005
USPC ..... 446/26, 28, 236, 242, 485
See application file for complete search history.

(56) References Cited

U.S. PATENT DOCUMENTS 4,523,258 A 6/1985 Morse et al.
4,619,125 A 10/1986 Choi
4,715,839 A 12/1987 Ford et al.
5,041,947 A 8/1991 Yuen et al.
5,057,827 A * 10/1991 Nobile et al. ..... 345/31
5,190,491 A * 3/1993 Connelly ..... 446/242
5,245,516 A 9/1993 de Haas et al.
5,406,300 A 4/1995 Tokimoto et al.
5,791,966 A * 8/1998 Capps et al. ..... 446/242
5,872,554 A * 2/1999 Chang et al. ..... 345/690
6,037,876 A * 3/2000 Crouch ..... 340/815.53
6,072,386 A 6/2000 Yu
6,077,194 A 6/2000 Chang
6,098,252 A 8/2000 Woerth
6,220,916 B1 4/2001 Bart et al.
6,239,774 B1 * 5/2001 Altman ..... 345/31

(Continued)

FOREIGN PATENT DOCUMENTS

JP 08043563 A 2/1996
JP 09197991 A 7/1997

(Continued)

OTHER PUBLICATIONS

English Translation to Abstract JP2006130271.

(Continued)

*Primary Examiner* — Gene Kim
*Assistant Examiner* — Alyssa Hylinski
(74) *Attorney, Agent, or Firm* — Cantor Colburn LLP

(57) ABSTRACT

An amusement device includes a rotating assembly display rotatably mounted about a center point configured to create a plurality of images via a persistence of vision effect. The rotating assembly includes a sensor disposed on the rotating assembly at a location closer to an end of the rotating assembly than to the center point. The amusement device also includes a device for rotating the rotating assembly and a control circuit including a first microcontroller in operable communication with the sensor. The microcontroller controls a speed at which the device for rotating the rotating assembly rotates the rotating assembly based on communications with the sensor.

31 Claims, 8 Drawing Sheets

(56) References Cited

U.S. PATENT DOCUMENTS

| | | | | |
|---|---|---|---|---|
| 6,265,984 | B1 * | 7/2001 | Molinaroli | 340/815.4 |
| 6,270,391 | B1 | 8/2001 | Emilsson | |
| 6,278,419 | B1 * | 8/2001 | Malkin | 345/31 |
| 6,325,690 | B1 * | 12/2001 | Nelson | 446/25 |
| 6,789,925 | B1 | 9/2004 | DeGregorio | |
| 6,886,724 | B2 | 5/2005 | Hung | |
| 6,893,317 | B1 | 5/2005 | Vlodek | |
| 6,920,672 | B1 | 7/2005 | Hubbard | |
| 7,037,169 | B2 | 5/2006 | Benedek et al. | |
| 7,079,042 | B2 | 7/2006 | Reim | |
| 7,179,149 | B2 | 2/2007 | Chernick et al. | |
| 7,204,740 | B2 | 4/2007 | Petell | |
| 7,210,816 | B2 * | 5/2007 | Lin | 362/234 |
| 7,254,872 | B2 | 8/2007 | Ross | |
| 7,259,691 | B2 | 8/2007 | Kimbrough, Jr. | |
| 7,347,758 | B2 | 3/2008 | Moore | |
| 7,361,074 | B1 * | 4/2008 | Periman et al. | 446/242 |
| 7,477,208 | B2 | 1/2009 | Matlock et al. | |
| 7,766,718 | B2 * | 8/2010 | Rago et al. | 446/242 |
| 8,348,712 | B2 * | 1/2013 | De La Torre | 446/34 |
| 2004/0005841 | A1 | 1/2004 | Chernick et al. | |
| 2004/0162127 | A1 | 8/2004 | Siegel et al. | |
| 2004/0187184 | A1 | 9/2004 | Rubin et al. | |
| 2005/0174308 | A1 * | 8/2005 | Matlock et al. | 345/82 |
| 2006/0063466 | A1 | 3/2006 | Conarro | |
| 2006/0094327 | A1 | 5/2006 | Chernick et al. | |
| 2006/0160457 | A1 | 7/2006 | Moore | |
| 2006/0270309 | A1 | 11/2006 | Kessler | |
| 2007/0049159 | A1 * | 3/2007 | Kulis, II | 446/438 |
| 2007/0124848 | A1 | 6/2007 | Faniran | |
| 2007/0167107 | A1 | 7/2007 | Petell et al. | |
| 2007/0254553 | A1 | 11/2007 | Wan | |
| 2007/0281581 | A1 * | 12/2007 | Rago et al. | 446/242 |
| 2008/0019120 | A1 | 1/2008 | Rapisarda | |
| 2008/0024976 | A1 * | 1/2008 | Hardson et al. | 361/686 |
| 2008/0062007 | A1 | 3/2008 | Kimbrough | |
| 2008/0242190 | A1 | 10/2008 | Hofer et al. | |
| 2008/0242191 | A1 | 10/2008 | Chernick et al. | |
| 2009/0002290 | A1 * | 1/2009 | Chui | 345/87 |
| 2009/0002293 | A1 * | 1/2009 | Chui | 345/87 |
| 2010/0097448 | A1 * | 4/2010 | Gilbert et al. | 348/51 |

FOREIGN PATENT DOCUMENTS

| | | | |
|---|---|---|---|
| JP | 2005247251 | A | 9/2005 |
| JP | 2006130271 | A | 5/2006 |
| JP | 2007146311 | A | 6/2007 |

OTHER PUBLICATIONS

English Translation to Abstract JP2007146311.
English Translation to Abstract JPH09197991.
English Translation to Abstract JP2005247251.
English Translation to Abstract JPH0843563.

* cited by examiner

TOY WITH PERSISTANCE OF VIEW COMPONENTS

CROSS REFERENCE TO RELATED APPLICATION AND PRIORITY CLAIM

This application is related to and claims the benefit of priority under 35 U.S.C. 119(e) to U.S. Provisional Patent Application Ser. No. 61/373,316, entitled TOY WITH PERSISTANCE OF VIEW COMPONENTS, filed Aug. 13, 2010, and which is hereby incorporated by reference in its entirety.

BACKGROUND

Toys involving lights and sounds are popular with individuals, be they a child or an adult. Individuals also enjoy toys that have changing visual appearances and/or sound effects. Many toys exist and some are fun to play with.

BRIEF SUMMARY OF INVENTION

An exemplary embodiment of the present invention are directed to an amusement device that includes a rotating assembly display rotatably mounted about a center point configured to create a plurality of images via a persistence of vision effect. The rotating assembly of this embodiment includes a sensor disposed on the rotating assembly at a location closer to an end of the rotating assembly than to the center point. The amusement device of this embodiment also includes a device for rotating the rotating assembly and a control circuit including a first microcontroller in operable communication with the sensor. The microcontroller controls a speed at which the device for rotating the rotating assembly rotates the rotating assembly based on communications with the sensor.

Another exemplary embodiment of the present invention is directed to an amusement device that includes a rotating assembly display rotatably mounted about a center point configured to create a plurality of images on a display space via a persistence of vision effect caused by light emitted by light sources on the rotating assembly, the images being greyscale and having at least three different states including a BRIGHT state, an OFF state and a DIM state. The device also includes a device for rotating the rotating assembly and a control circuit including a first microcontroller for providing display information to the rotating assembly for creating the images, the display information being based on pixels in a source image wherein each pixel is displayed based on the display space based on a plurality of locations of the rotating assembly.

Another exemplary embodiment of the present invention is directed to an amusement belt that includes a buckle portion and fasteners for securing the buckle portion to a user. The buckle portion of this embodiment includes a rotating assembly display rotatably mounted about a center point configured to create a plurality of images via a persistence of vision effect, the rotating assembly including a sensor disposed on the rotating assembly. The buckle portion also includes a device for rotating the rotating assembly and a control circuit including a first microcontroller in operable communication with the sensor, the microcontroller controlling a speed at which the device for rotating the rotating assembly rotates the rotating assembly based on communications with the sensor.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

DETAILED DESCRIPTION OF EXEMPLARY EMBODIMENTS

In accordance with an exemplary embodiment of the present invention, an amusement device in the form of a belt is disclosed. The belt of this embodiment includes a persistence of view (POV) device embedded therein or otherwise coupled to it.

While the following discussion details a belt, it shall be understood that the invention is not limited to belt. That is, embodiments of the present invention may be directed to a POV device as described herein or any portion thereof. In addition, it shall be understood, that the POV device may be included in other types of amusement devices that those shown herein.

Figure 1:
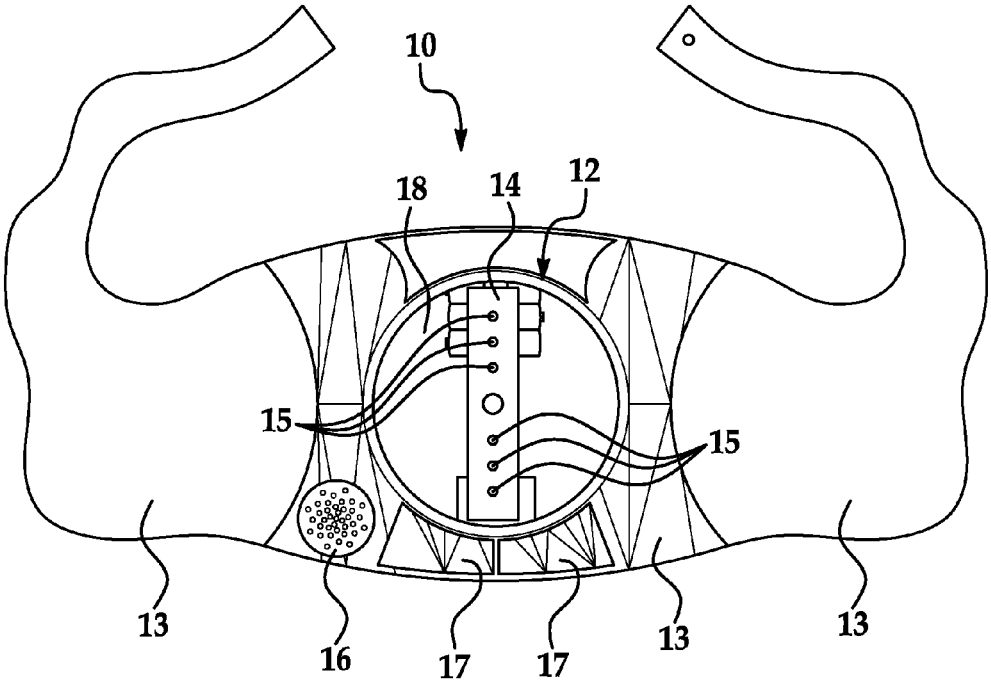
FIG. 1 is a front view of an amusement device in the form of a belt constructed in accordance with an embodiment of the present invention.

FIG. 1 shows a front view of an example of a belt 10 according to one embodiment. The belt 10 includes a POV device 12 embedded within the buckle portion 11 of the belt. The belt 10 may also include optional attachment members 13 to hold the belt around, for example, the waist of a user.

In one embodiment, the (POV) device 12 creates a plurality of images via a persistence of vision effect wherein a rotating assembly 14 with intermittently illuminated light sources 15 produces a polar raster display of individual, addressable pixels. The light sources are light emitting diodes (LEDs) in one embodiment.

Rotation of the assembly 14, combined with changing the illumination of the light sources 15 produces a series of flashing frames that blend to form a recognizable image, or series of animated images that may move around the display area 18 of the POV device 12. Devices that utilize persistence of vision technology receive electronic information about an image to be displayed and the information is used to synchronize the illumination of individual illuminating light sources 15 at specific positions during rotation of the rotating assembly 14. While not visible in FIG. 1, it shall be understood that the buckle portion 11 may include a transparent cover that protects the POV device 12.

In more detail, POV refers to displays formed by blinking light source (e.g., light sources 15) as they are moved regularly and repeatedly through a defined space. The light stimulates the eye, and this stimulus takes an amount of time to fade. Blinking a one of the light sources 15 repeatedly as it passes through a particular coordinate, at a rate faster than the rate at which the stimulus fades from the eye, causes the brain to register the light point as a fixed, nonmoving, non-blinking light source, or pixel. Mapping a large number of these points in space and time allows the creation of a display in space.

Many combat sports and combat-related sports such as boxing and professional wrestling award championship belts to various champions. Children of all ages like to pretend that they are champions and, in particular, that they are champions in combat sports. Accordingly, in one embodiment, the belt 10 in general or the buckle portion 11 in particular, is fashioned such that the belt 10 looks generally like a championship belt of one of the combat sport sanctioning bodies. For example, the belt 10 may appear to be generally one of a World Wrestling Entertainment (WWE) championship belt, a World Boxing Organization (WBO) championship belt, a World Boxing Council (WBC) championship belt, International Boxing Federation (IBF) championship belt, an Ultimate Fighting Championship (UFC) belt or the like. Of course, the belt 10 could be any type of belt.

In the same vein, many famous fighters have specific music or other audio that plays as they enter the ring. As such, in one embodiment, the belt 10 includes a speaker 16 or other audio projection device that plays audio. In one embodiment, the speaker 16 plays audio that accompanies one or more images displayed on the POV device 12. Embodiments of the present invention include a control circuit (not shown) that controls operation of the POV device 12 and the speaker 16 and may, in one embodiment, control synchronization between the two. In a particular embodiment, the images are related to specific fighter and the speaker 16 plays audio related to the fighter.

It shall be understood that the teachings herein are not limited to presenting images of fighters and their associated audio. Indeed, any combination of images and audio may be presented. Of course, images alone or audio alone could be presented in one embodiment.

To the extent user interaction is needed, the buckle portion 11 includes one or more user interface devices 17 in one embodiment. The user interface devices 17 are buttons in one embodiment and are utilized to allow a user to interact with the POV device 12. For example, the user interface devices 17 allow the user to select from one or more operating modes in one embodiment. One or more of the operating modes includes synchronized images and audio that are presented by the POV device 12 in combination with the speaker 16. It shall be understood that, in one embodiment, the operating modes images can be stored in one microprocessor on a rotating assembly and the audio in a separate microprocessor on a stationary portion of the POV device 12.

Figure 2:
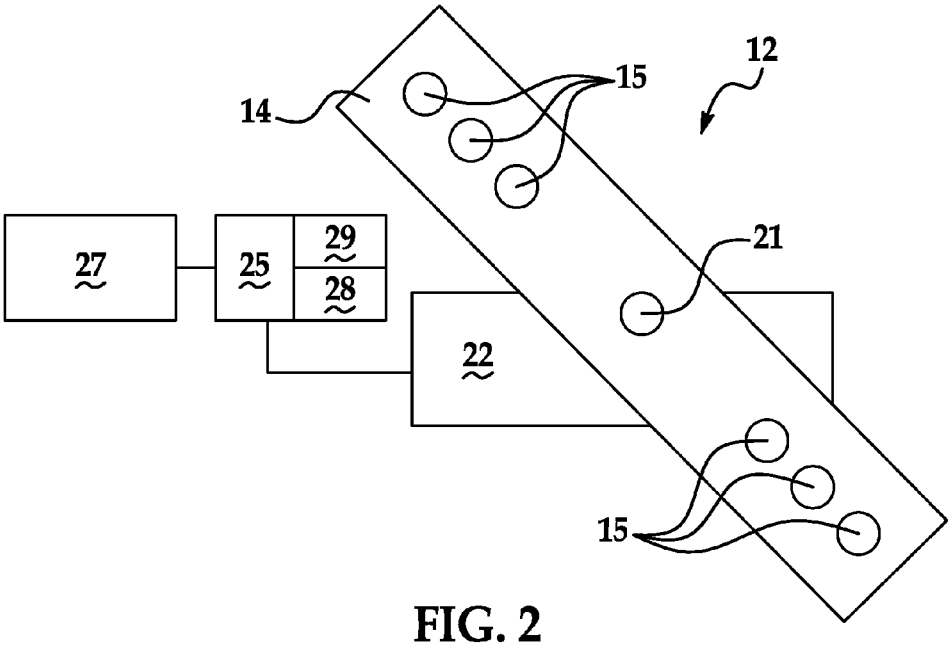
FIG. 2 is a block diagram of a persistence of vision device (POV) in accordance with an embodiment of the present invention.

FIG. 2 shows a block diagram of a POV device 12 according to one embodiment. The POV device 12 of this embodiment includes a rotating assembly 14. The rotating assembly 14 is caused to rotate about a center point 21 in one embodiment and includes a plurality of light sources 15. The light sources 15 are disposed on both side of the center point 21 in embodiment. As the rotating assembly 14 rotates, the blur perceived by the eye makes the rotating assembly 14 appear to be a flat circle. This virtual circle formed by the rotating assembly 14 forms a visual image. The brightness and illumination timing of the light sources 15 on the rotating assembly 14 are controlled by a control circuit 25 in one embodiment and may be utilized to vary the images.

In order to provide a rotational force to the rotating assembly 14 and in order to provide visual images, a device or motor or other equivalent mechanism 22 is provided to supply the rotational force to the rotating assembly 14. In an exemplary embodiment, the POV device 12 includes a control circuit 25 coupled to a power supply 27. The control circuit 25 includes a first microcontroller 28 (FIG. 4) in operable communication with the rotating assembly 14 to control operation of light sources 15 by selectively causing them to be illuminated. The power supply 27 provides power to the mechanism 22 and any of the other devices requiring power (e.g., microcontroller 28, sound system, light sources 15, etc.).

As discussed above, the microcontroller 28 controls operation of the light sources 15. In addition, the microcontroller 28 includes, in one embodiment, some or all of the algorithms, instructions, calculations or the like to cause the POV device 12 to present images. In addition, the microcontroller 28 may control the audio produced by speaker 16 (FIG. 1) and control the synchronization of the audio and the images. In an exemplary embodiment, the microprocessor 28 or other equivalent processing device is capable of executing commands of computer readable data or program for executing a control algorithm that controls the operation of the amusement device. In order to perform the prescribed functions and desired processing, as well as the computations therefore (e.g., the execution of fourier analysis algorithm(s), the control processes prescribed herein, and the like), the controller may include, but not be limited to, a processor(s), computer(s), memory, storage, register(s), timing, interrupt(s), communication interfaces, and input/output signal interfaces, as well as combinations comprising at least one of the foregoing. For example, the microcontroller 28 may include input signal filtering to enable accurate sampling and conversion or acquisitions of such signals from communications interfaces. In accordance with an exemplary embodiment of the present invention one contemplated microcontroller is an AM4EG series or AM4ED series microcontroller available from Alpha Microelectronics Corp or may be Holtek HT86xxx MCUs. Of course, any other equivalent devices are considered to be within the scope of exemplary embodiments of the present invention. As described above, exemplary embodiments of the present invention can be implemented through computer-implemented processes and apparatuses for practicing those processes.

Further, it shall be understood that the microcontroller 28 may be configured to receive information from an external source via either a wire or wirelessly. As such, in one embodiment, the control circuit 25 includes a communication interface 29 configured to receive information from an external source. The information received is related to images to be displayed by the POV device 12 in one embodiment. In such an embodiment, a user or another individual may be allowed to download images to be displayed by the POV device 12 from, for example, the Internet.

Figure 3:
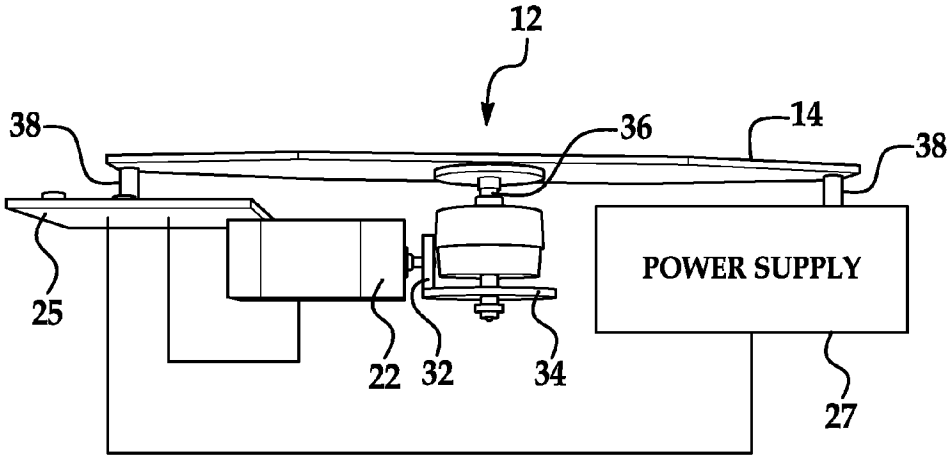
FIG. 3 is a side-view of one embodiment of a POV device according to the present invention.

FIG. 3 illustrates a side view of a POV device 12 according to one embodiment. The POV device 12 includes a rotating assembly 14 that rotates due to a force imparted on a drive shaft 36. In one embodiment, the motor 22 provides force to a drive cog 34 coupled to a rotational disk 34 that is coupled to the drive shaft 36. Of course, any means of transferring power from the motor 22 to the rotating assembly 14 can be utilized. For example, the rotating assembly 14 could be directly coupled to the motor 22 in one embodiment.

The control circuit 25 receives power from the power supply 27 and controls the power provided to the motor 22 in one embodiment. Controlling the power supplied to the motor 22 allows the control circuit 25 to, for example, control the rotational speed of the rotating assembly 14. In operation, the shaft 36 may contact brushes to provide power from the power source 27 to the light sources (not shown) disposed thereon.

As discussed above, the control circuit 25 in general, and the first microcontroller 28 (not shown) in particular, includes, in one embodiment, some or all of the algorithms, instructions, calculations of the like to cause the POV device 12 to present images. This information needs to be transmitted from the control circuit 25 to the rotating assembly 14 while the rotating assembly is in motion. It shall be understood, however, that in one embodiment, the microcontroller 28 need only transfer a display selection indication to the rotating assembly 14. The display selection indication can be based on input received, for example, from the interface devices 17 (FIG. 1). In such an embodiment, the display selection indication causes one or more different displays to be presented and the information for providing the selected display is stored in a storage device on the rotating assembly (e.g. in microprocessor 44 (FIG. 4) or memory associated therewith).

One approach to transferring information to rotating assembly includes providing an arm pointing an infra-red LED into the center of the rotating assembly 14 to provide asynchronous communication of image information. Alternatives include utilizing a hollow drive shaft 36 that allows for an LED to pass communications there through or remote control communication techniques such as radio or modulated infrared (IR).

In a particular embodiment and as shown in FIG. 3, the rotating assembly 14 includes a sensor 38 on at least one end. Of course, the rotating assembly may include a sensor 38 at each end in one embodiment. The sensor 38 passes over an optical or other communication source on the control circuit 25 and receives information in that manner. In particular, the information is received in a bit-per-revolution manner. As such, one of the sensors 38 is utilized for communication and the other sensor is used for positional information in one embodiment.

Figure 4:
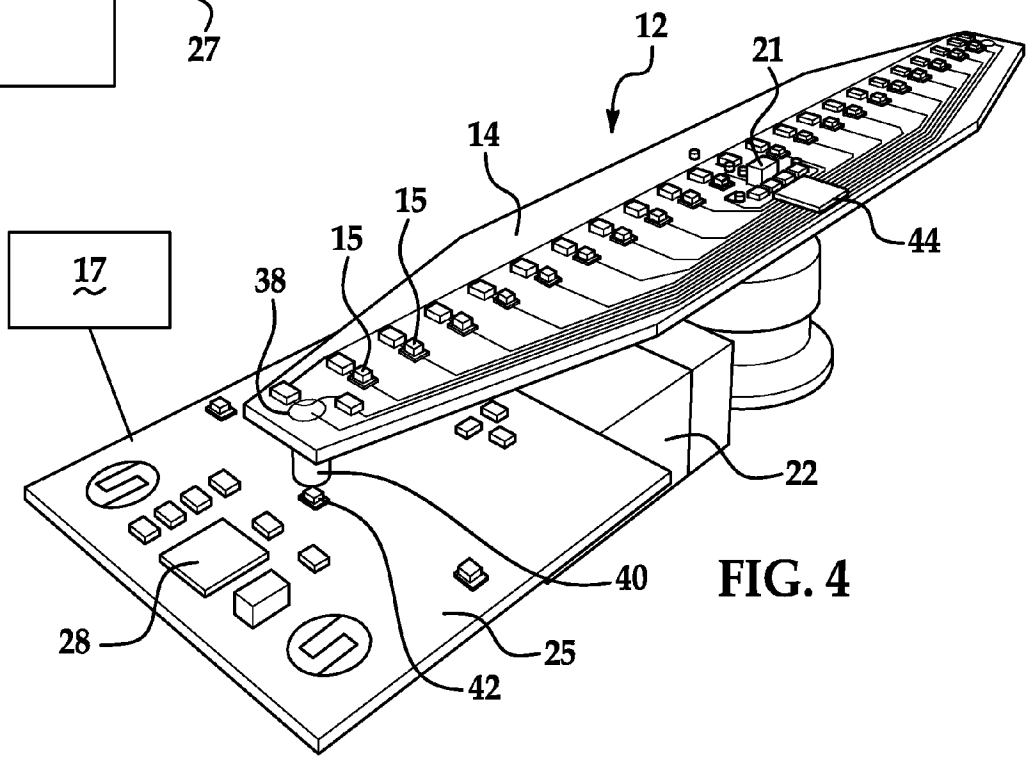
FIG. 4 is a perspective view of a POV device according to the present invention.

FIG. 4 shows a perspective view of the POV device 12 shown in FIG. 3. The POV device 12 is connected to optional speaker 16 in this illustration but that is not required. In this embodiment, the rotating assembly 14 includes light sources 15 disposed on either side of a center point 41 about which the rotating assembly 14 rotates. Of course, the light sources 15 could be constrained to a single side of the center point 41. Displacing the light sources as shown in FIG. 4, however, reduces display flicker and makes balancing the rotating assembly 14 easier. A more balanced rotating assembly 14 may reduce vibration and associated power loss, image degradation and mechanical stress. In addition, such a configuration reduces overall rotating mass because components can be arranged to almost mirror each other, eliminating the need for additional dead weight added for balance.

In a particular embodiment, the rotating assembly 14 includes 22 light sources 15. As above, one half (11) of the light sources 15 in this embodiment are disposed on one side of the center point 41 and the other half are disposed on the other side the center point 41. In one embodiment, each light source 15 is a fixed distance from its nearest neighbor. For example, each light source 15 may be about 6 mm from it closest neighbor. In one embodiment, the light source 15 closest to the center point 41 on one side rotating assembly 14 is closer to the center point 41 than the light source 15 closest to the center point 41 on the other side of the center point 41.

Figure 5:
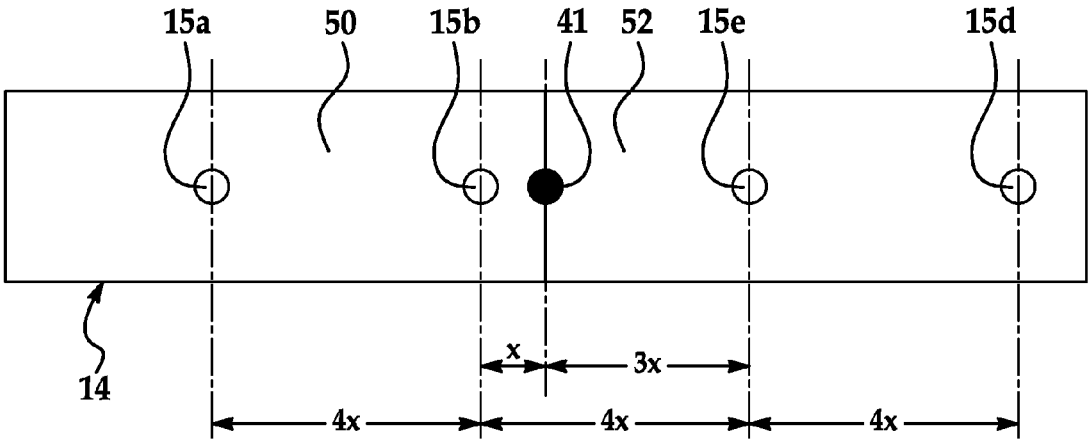
FIG. 5 is a top view of rotating member according to one embodiment.

For example, and as shown in FIG. 5, the closest light source 15*a* on a first side 50 of the rotating assembly 14 is at a first distance x from the center point 41. In this example the next adjacent light source 15*b* on the first side is 4× away. Conversely, on the second side 52 of the rotating assembly 14, the closest light source 15*c* is 3× away form the center point 41 while still being 4× away from light source 15*a*. All of the light sources 15*a*-15*d* are 4× from their adjacent neighbors. As such, the rotating assembly 14 is substantially balanced and the offset allows for diodes on one side to fill gaps in the other while rotating and may help reduce flicker.

Referring again to FIG. 4, the control circuit 25 includes a microprocessor 28 that controls the timing of when and of how long the light sources 14 are illuminated to produce the desired images. POV devices in general and POV device 12 in particular, require that the microcontroller 28 knows the rotation rate of the rotating assembly 14. In prior POV devices, a hall effect sensor was typically utilized to determine the rotation rate of the rotating assembly 14. Such a system, however, may lead to substantial jitter at the outer edges of the display.

According to an embodiment of the present invention, an optical rotation detector system determining the rotation of the rotating assembly 14 is utilized. The optical rotation system includes an optical emitter 42 on the control circuit 25 and an optical receiver 38 on the rotating assembly 14. The receiver 38 includes a light guide 40 in one embodiment. The error inherent in such an embodiment may be described as the product of the physical diameter of the emitter or detector and the manufacturing tolerance of their gain divided by the distance from the center of rotation. Moving the rotation detector system to the outermost edge of the rotating assembly 14, thus, reduces error/jitter in the display. Accordingly, in one embodiment, the optical receiver 38 is located closer to an end of the rotating assembly 14 than to the center point 21.

As discussed above, the receiver 38 may also receive communications from the optical emitter 42 to control operation of the light sources 15. As such, in one embodiment, the rotating assembly 14 includes a second microprocessor 44 disposed thereon. The second microprocessor 44 interprets the communications and causes the light sources 15 to operate in the desired manner. In such an embodiment, and as described briefly above, the second microprocessor 44 may include information that is to be provides to the light sources based on different modes. The modes can cause different images to be displayed by the rotating assembly 14.

In one embodiment, the control circuit 25 is coupled to a speaker 16. Audio produced by the speaker 16 is synchronized to the images displayed by the POV device 12 in general and by the rotating display 14 in particular. In the prior art, a typical arrangement utilizes the rate of rotation to clock images in an animation sequence. For instance, a pulse each revolution would be used as the trigger to change display images in a sequence. The advantage to this system is that it is very simple. The disadvantage is that the synchronization of sound and animation is dependent on the speed of the motor 22 used to rotate the rotating assembly 14. In some cases a battery is used to provide power to the motor 22. In such cases, as the battery runs down, the speed of the motor 22 decreases and, thus, the rate at which the sequence of images switches decreases. As the speed decreases, the images and sound become out of synch. Embodiments of the present invention may be utilized to synchronize audio to images while overcoming the shortcomings of the prior art.

One embodiment of the present invention is directed to presenting images at a minimum frame rate. As discussed above, the rate of rotation of the rotating assembly 14 is constantly measured by the microprocessor 28 in one embodiment. In this embodiment, the microprocessor 28 causes the voltage provided to the motor to be adjusted by utilizing, for example, pulse width modulation (PWM) to keep the speed of rotation at the standardized rate. In such a manner, image and sound remain in synch.

In another embodiment, synchronization is enforced by utilizing real-time step sequences. That is, the microprocessor 44 on the rotating assembly 14 steps through a series of images with each step being performed based on a real time clock. For example, the microprocessor 44 may cause a series of images to be performed where each image is displayed for one or more predetermined time periods (i.e., in 100 mS units). In such an embodiment, the audio produced by the speaker 16 is also controlled in the same manner.

As discussed above, a battery may serve as the power supply 27 (FIG. 3) in one embodiment. In such an embodiment, the amount of power in the battery may affect the operation of the POV device 12. One inherent difficulty such a system is that as the battery is drained, the motor speed drops. Accordingly, one possible failure mode of the POV device exists where the motor 40 is unable to turn rotating assembly 14 fast enough to create acceptable image quality. Another possible failure mode may occur due to slow rotation speed causing overflow of rate counters in the microprocessor 28. Yet another possible failure mode may occur when the batteries cannot provide enough power to illuminate the light sources 15. According to one embodiment, some or all of the failure modes are addressed by continuously monitoring the rotation rate with both the first microprocessor 28 and the second microprocessor 44. If either determines that the rate is below the required rate, the rotation of the rotating assembly 14 is stopped in one embodiment.

Figure 14:
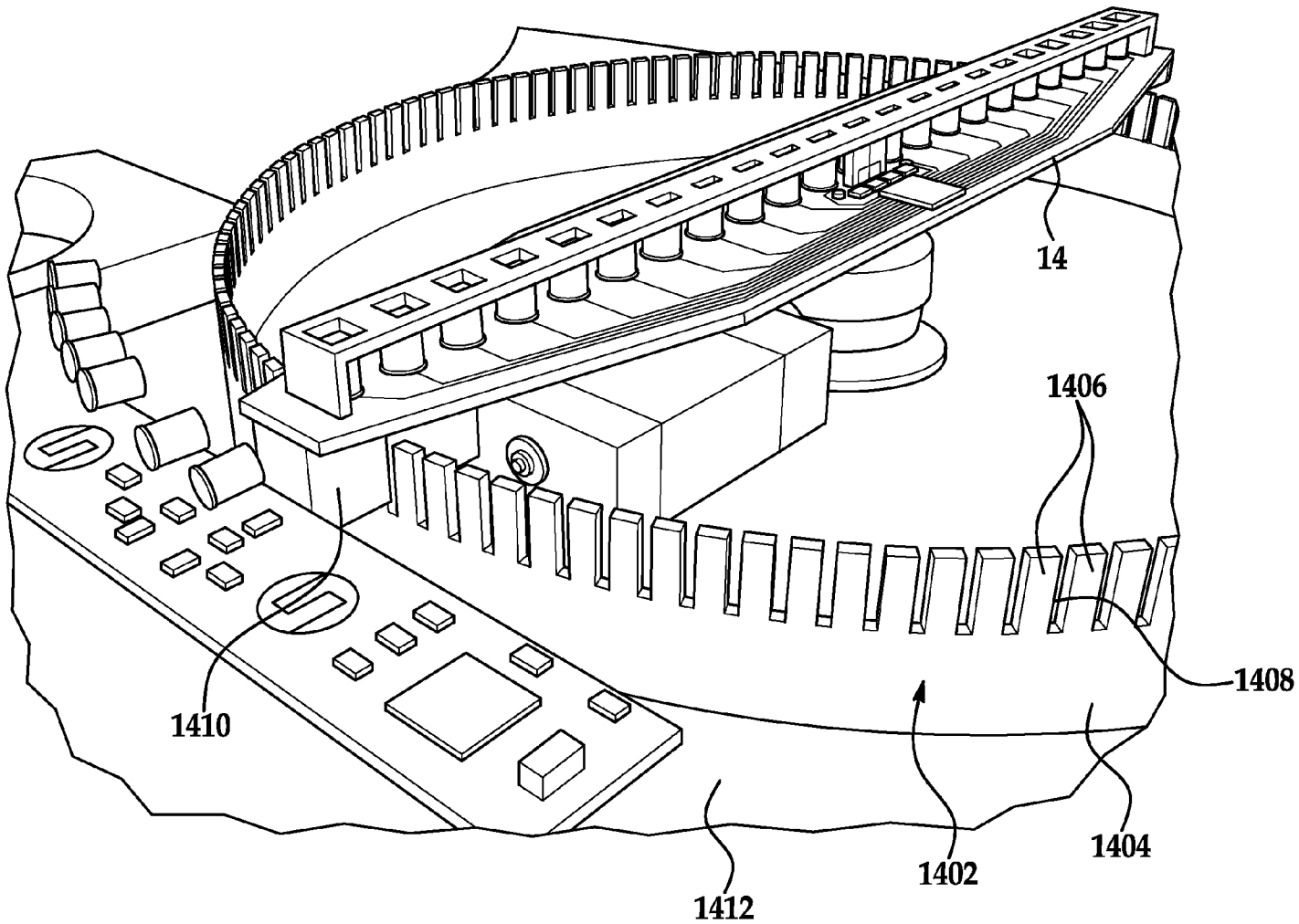
FIG. 14 illustrated a POV device including a gating mechanism according to one embodiment.

According to another embodiment, and as illustrated in FIG. 14, the POV device 12 includes a gating mechanism 1402. As illustrated, the gating mechanism is located on a base 1412 region. The base region 1412 forms a support structure for the POV device 12 and could be included, for example, as a part of an amusement device such as the belt described herein.

In one embodiment, the gating mechanism 1402 can be implemented as ring 1404 having teeth 1406 disposed thereon. The spaces 1408 between the teeth 1406 allow light to pass between portions of a sensor 1410. As one of ordinary skill will realize, the rate that the light is detected will create a pulse train that exactly relates to the rotational speed of the rotating assembly 14. This pulse train can be used synchronize an image with audio in one embodiment. Of course, this pulse train could be used for any synchronization function.

Furthermore, the gating mechanism 1402 illustrated in FIG. 14 can provide additional advantages. For example, in a traditional POV system, a switch or LED is used to detect a point of rotation, the time interval between these points, and divide this interval into a number of steps for producing an image. At each of these steps, a new set of pixel data is displayed. One problem with this approach is that it is difficult to evenly divided the rotation duration using fixed-point math and timing, so there can exist rounding errors. Such errors can result in jitter and do not exist if the gating mechanism 1402 is utilized. Of course, the number of teeth 1408 should match the number of steps in the display space.

Another problem is related to the processing overhead required to perform the timing and calculations. Utilizing the gating mechanism 1402 allows each step point to be determined by the pulse train and, thereby, reduces or eliminates timing-induced jitter the processing overhead associated with timing calculations and interrupts.

In the preceding explanation, it has been assumed that the rotating assembly 14 includes its own microprocessor 44. Of course, only a single microprocessor, e.g. first microprocessor 28 could be utilized. In particular, the rotating assembly 14 could only include latches. In such an embodiment, the particular pattern of light source 15 illumination could be stored in latches (shift registers) instead and shifted out to each light source 15 based on the rotation of the rotating assembly 14.

Alternatively, in one embodiment, in operation, all information could be contained in the second microprocessor 44 and the first microprocessor 28 omitted. In such an embodiment, the second microprocessor 44 could include all of the audio and image information. In such an embodiment, the audio information could be transmitted from the second microprocessor 44 through communication interface 29 and provided to the speaker 16. Of course, the audio could be transmitted in other manners such as, for example, through a hollow shaft or a donut-shaped light pipe with frosted surface.

In operation, an image to be displayed on the POV device 12 needs to be converted from conventional format (e.g., stacked rows of pixels) to rotating strings of pixels in a POV image. To accomplish this, embodiments of the present invention are directed to methods of making such conversions.

Figure 6:
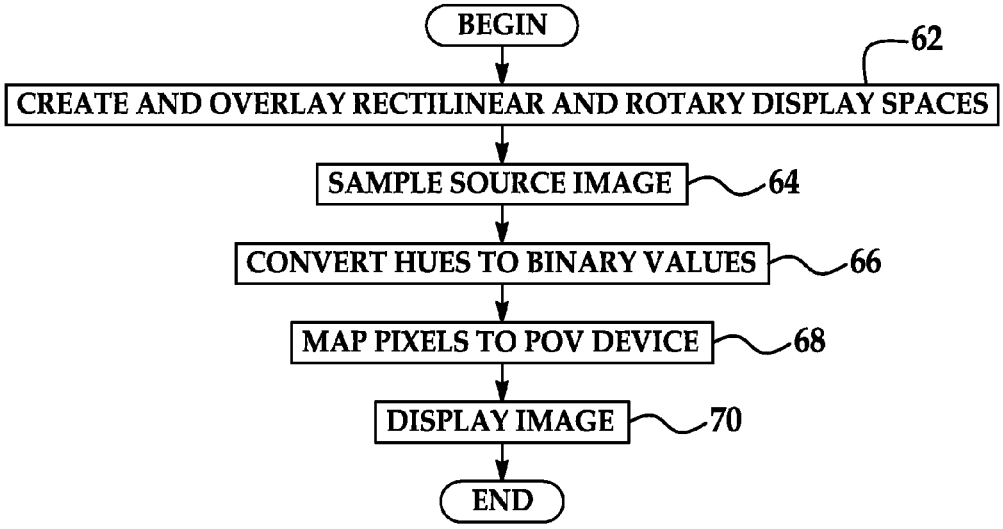
FIG. 6 shows a method according to one embodiment of the present invention.

FIG. 6 is a flow chart of one method according to the present invention. At a block 62, rectilinear and rotary display spaces are created and overlaid. This may include, for example, sizing and cropping an initial image such that it will fit in the display area of the POV device 12. It will be understood that the rectilinear (original) image is formed by a rows and columns of pixels. In one embodiment, algorithms on in the microprocessor 28 may perform this overlaying. Of course, an external computing device could perform the operations of block 62 as well as other blocks of this method. Overlaying the rectilinear and rotary display spaces can include utilizing rules that define the display space. The display space is defined, for example, based on size and spacing of the light sources and the effect of any lenses or masks that may be overlaid on the light sources can have on the shape or spacing of the light produced by them.

At a block 64 the pixels of the source (original) image are sampled. Such a sampling will result in hues (assuming a color source image) for each pixel being recorded. The sampling performed may be one of a few different types of sampling. For example, the pixels may be sampled based on a dead center sample in the center of the source pixel. Alternatively, an average sampling where a number points across the pixel area are sampled and then averaged to determine if a particular pixel is on.

At a block 66 the hues are converted to binary values based on whether they exceed a threshold. The threshold may vary depending on the type of sampling performed. For instance, if more than one half of the points on a pixel exceed an "on/off" value, the pixel is "on." In an alternative embodiment, the display space may be implanted as a greyscale display. In such an embodiment, the hues are converted to more descriptive binary values. For example, rather than just "1" or "0", each pixel could be converted to one of four values "00", "01", "10" and "11" that, respectively, represent OFF, DIM, MEDIUM and BRIGHT pixels. It shall be understood and as explained later, that pixels can represent OFF, DIM, MEDIUM and BRIGHT states by controlling the time the light source is illuminated rather than an intensity of the illumination.

At a block 68 the off and on pixels are mapped between the source image and the POV display. This can include converting the stacks of rows of pixels in the original image to the defined rotating strings of pixels in a POV display space (like spokes on a wheel). According to one embodiment, mapping the on and off pixels in block 508 includes accounting for asymmetry between on and off pixels, in that off pixels are swamped by, or hidden underneath, on pixels. To this end, the mapping of block 508 includes applying interpretation rules that adjust pixel values to compensate for this. Such interpretation rules may include interpreting the shades, colors, values and rectilinear pixel spaces for the number of shades in the POV display. In addition, the mapping may include reliance on the radial pixel arrangement and the type of overlap in the POV display. Examples of mapping algorithms are described in greater detail below.

At a block 70 the mapped image is then displayed. Of course, displaying the mapped image can include processing or other steps that transfer the data of the data to be displayed by the POV device from the first microprocessor 28 to the second microprocessor 44 in any of the manners described herein.

As discussed briefly above, it may be desirable to implement the POV device 12 such that the display area displays greyscale images. In such a case, rather than a single bit binary representation, two bits can be assigned to represent OFF, DIM, MEDIUM and BRIGHT pixels in the source image. According to one embodiment, each value is interpreted as different light source lit durations. The durations can be non-linearly related to one another in one embodiment. However, because the light sources are rotating, the result is different length arcs drawn in space. For image clarity it may be desirable to avoid pixel overlap and, as such, the final result is an increase or decrease in average brightness for a particular pixel area. As will be readily realized, due to the fixed physical size of the light sources and the fact that the distance traveled by each light source in a rotating display increases proportional to its distance from the display center point, overlap reduction results in either reduced brightness in the center of the display or an inability to effectively control the ratio of LED "off" to "on" time to create the OFF, DIM, MEDIUM and BRIGHT levels in the center of the display.

Figure 7:
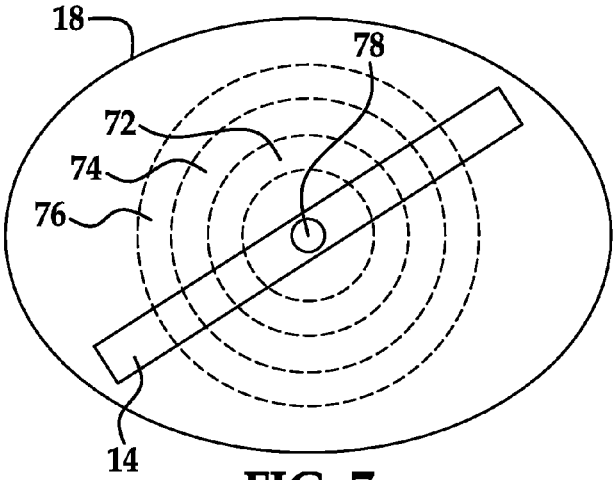
FIG. 7 illustrates different band in a display space of a POV device to illustrate embodiments of the present invention.

One solution to the problem of pixel overlap is to reduce the maximum on-time for each area or "band" in a display. Such compensation could be included, for example, in steps 68 and 70 above. For example, and as shown in FIG. 7, the display area 18 includes a plurality of bands 72, 74, 76. In each band the maximum on time for an LED (e.g., the time implemented for the "BRIGHT" state) is set to a specific level. In one embodiment, the maximum time increases as the bands move further from the center point 78 of the rotating assembly 18. Thus, as illustrated, the maximum time for band 76 is greater than that of band 74 which, in turn, is greater than that of band 76. In one embodiment, the maximum display time may be doubled for each successive band moving away from the center point 78.

Another solution to the above problem is to implement an "even density" display. Such an even density display can be created, for example, when mapping the original image to the display space in at block 68 described above or when defining the display space at block 62. In a typical POV display, the display includes 256 interrupts, or steps, per rotation. At each of these steps a new POV data set is displayed and remains displayed until overwritten by the next set. As will be readily apparent, the can lead to significant overlap, especially in the center of the display. In practice, there would actually be fewer, larger pixels, as each must have an on-duration, and forms an oval across the display. According to one embodiment, and referring again to FIG. 7, an even density display can be created by analyzing the amount of overlap in each band and assigning each band a unique overlap value. Then, each band is assigned a specific number of pixels based on the overlap value such that overlap does not occur. In one embodiment, each band includes a number of pixels that divides evenly into the total number of pixels of the display 18. Of course, such a solution can lead to a decrease in information displayed due to reduced pixels that can be displayed in the inner bands. However, much of this information was effectively masked out due to overlap in any event. Such a so-called even density method of defining the display space may, advantageously, reduce or eliminate the need for a physical mask (as described below) to vary the size of the pixels produced by the light sources. That is, all pixels have the same size across the display space. Furthermore, from a digital memory point of view an even density representation can be implemented with normal storage methods by simply zeroing unused pixels. In one embodiment, the even density method is implemented by scanning each line of the original image and storing the result as a stack of scan lines. Each scan line is then retrieved and pixels that do not have a corresponding pixel in the display space are masked out and, thus, not transferred to the rotating display.

As discussed above, there are several solutions to problems associated with differing brightness and overlap in a POV display. Embodiments of the present invention can implement software and hardware solutions to such problems in combination or alone to reduce the brightness and overlap problems that may exist in some prior art POV displays.

Figure 8:
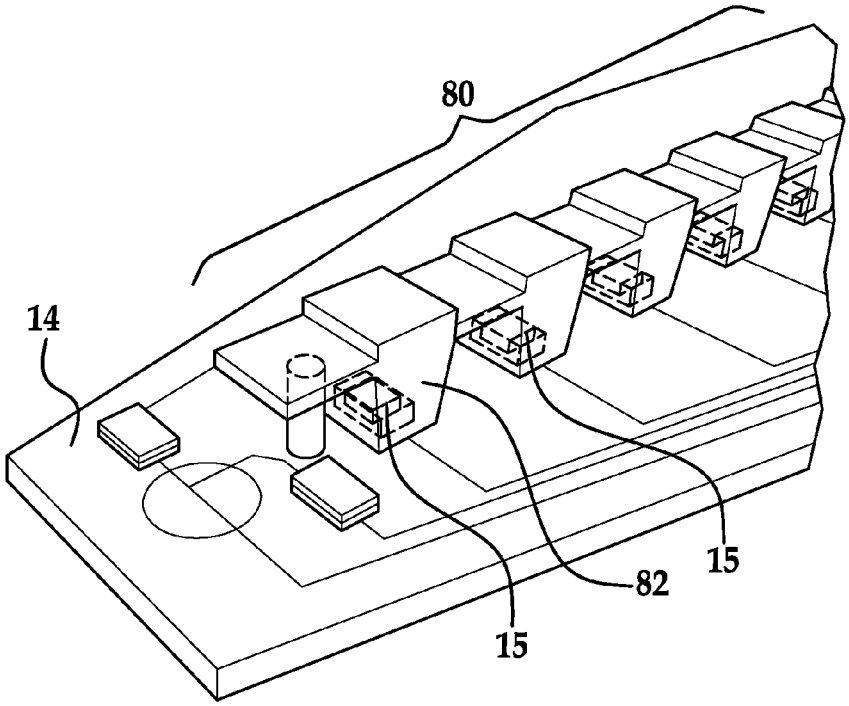
FIG. 8 illustrates an example of a lens array that can be included in embodiments of the present invention.

According one embodiment, and referring now to FIG. 8, the light sources 15 can be overlaid with a lens array 80 that includes a plurality if individual lenses 82. In one embodiment, the individual lenses 82 cause the light sources to project a rectilinear shape.

In the case of a greyscale display, a method of a setting timing rules for light source on/off ratios is described with reference to FIGS. 9 and 10. In one embodiment, the timing rules are set such that each non-full-brightness value (e.g., DIM and MEDIUM) is split into two time intervals. The first time interval is lit at the beginning of each step of the rotating assembly, and the second time interval is lit at the end of each step of the rotating assembly. After light spreading via the lens array 80 (FIG. 8) the result is that pixels of every brightness have substantially the same size, but appear to have different brightness due to their different average intensities.

Figure 9:
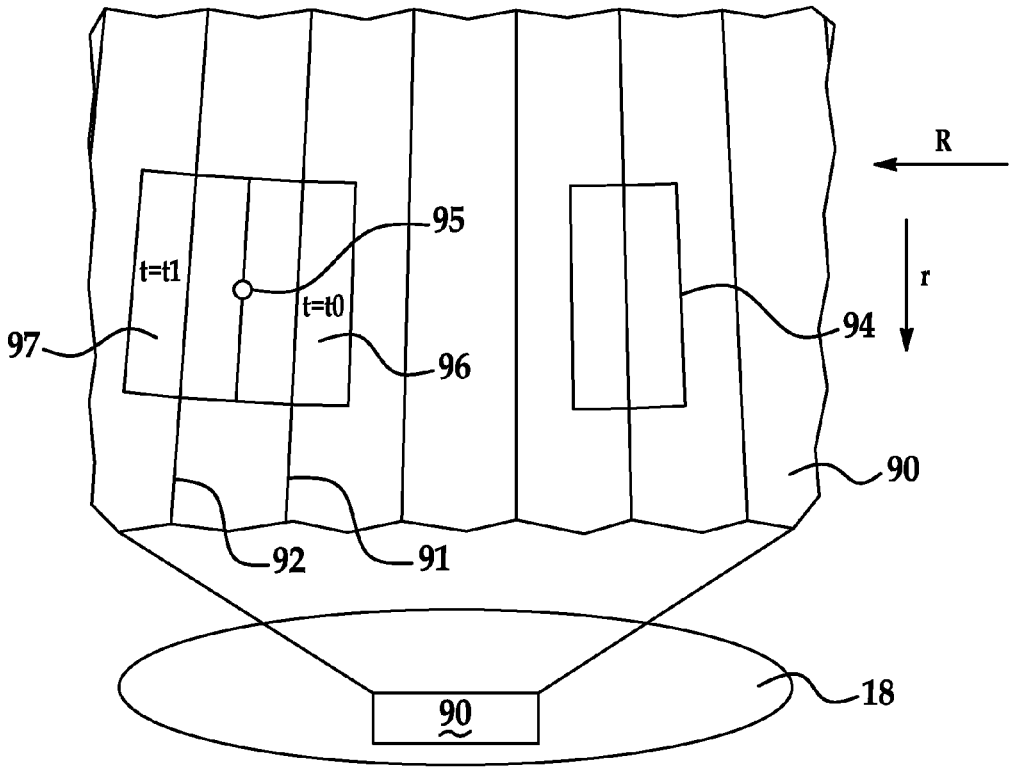
FIG. 9 shows an expanded view of display space of a POV device according to one embodiment.

In more detail, in FIG. 9 an exploded view of a portion 90 of a display area 18. The portion 90 includes lines 91, 92 that represent individual ones of the interrupts or steps in the rotation of the rotating assembly (not shown). For reference, an example of the shape of the light projected by one light source due to a lens as illustrated in FIG. 8 is shown as rectilinear block 94. According to one embodiment, a pixel scanned in the original image (represented by point 95) is represented by two adjacent locations 96, 97 of a particular light source. In FIG. 9, the first location 96 represents the location of the light source at a first time $t_1$ and the second location 97 represents the location at the next time $t_2$. In this manner, the original image pixel can be presented in the display area 18 based on the lighting of the light source in two different time intervals.

FIGS. 10A-10D are timing diagrams used to more fully explain how different pixel intensities of a greyscale image can be displayed. In one embodiment, the timing diagram can be used such that light pulses of varying durations are blended together to give the perception to a viewer of different intensities of pixels of the same size.

The timing diagrams are for use with a system that includes light spreading lenses such as those shown in FIG. 8. Such lenses will cause two sequential light pulses of a single pixel to be either overlap or at least be contiguous. In addition, it shall be understood that the human eye integrates close together areas having slightly different brightness levels. Referring again to FIG. 9, the lens causes light from the LED/pixel to be full size in the radial dimension r and half the size of a pixel (e.g., sections 96 and 97 form a single pixel display region on the display area 18) in the rotational direction R. In general, because the lenses/pixels are rotating and the LED on time is greater than zero, the portion of the display area 18 lit by the LED is always larger in the rotational direction R than the width of the lens. As more fully explained below, timing of the LED lighting is tuned so that one or more light pulses create contiguous non-overlapping pixels of varying intensities. The edges of every lit pixel are always defined by light at exactly the same beginning and end points. However the total number of photons in each pixel type is different. Since this light is spread over the same area for each pixel, when properly diffused the end result is pixels of the same size regardless of intensity.

Figure 10A:
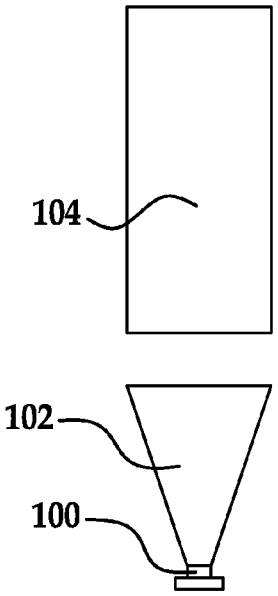
FIGS. 10A-10D are timing diagrams for an individual light source displaying adjacent pixels in a POV display according to one embodiment.
Figure 10B:
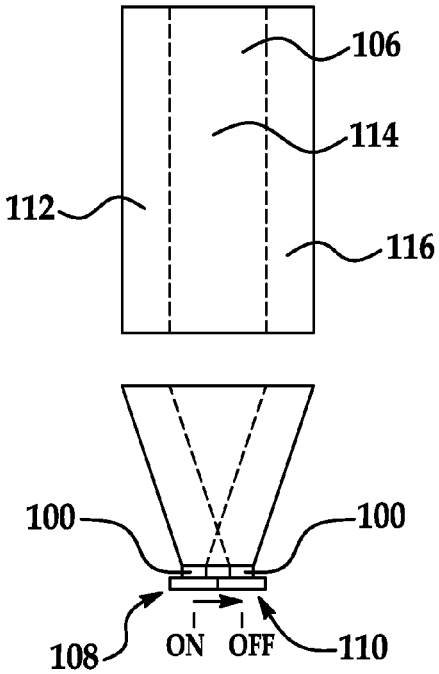
Figure 10C:
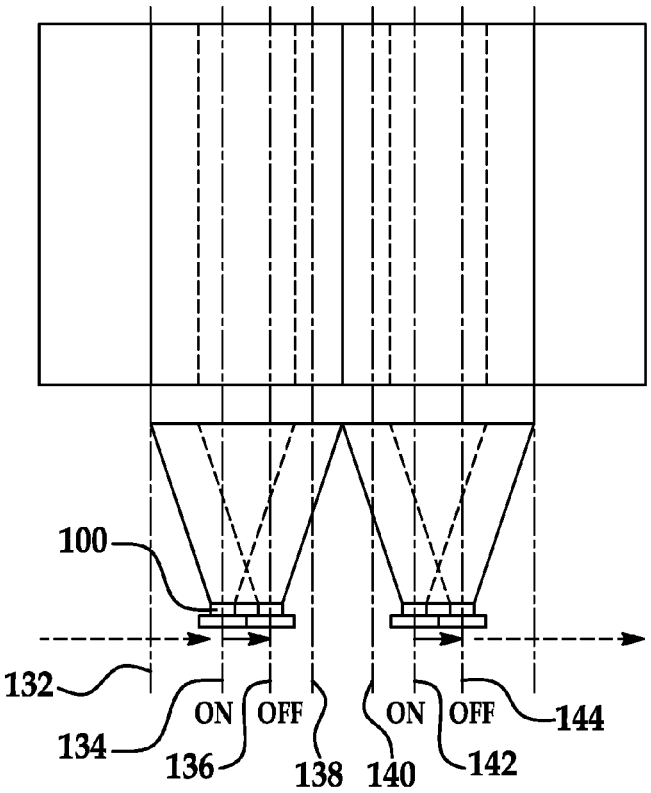

Referring now to FIG. 10A, an LED 100 is illustrated with a lens 102 as described above disposed thereon. The lens 102 diffuses light from the LED 100 such that it provides light on the display area having a shape as indicated by element 104 which is shown in top view. In FIG. 10B, element 106 represents a ½ of a pixel as displayed on the display area. Element 106 is formed by the light produced while the pixel 100 is located in first and second positions 108, 110. That is, FIG. 10B represents ½ of a DIM pixel and shows the relative times when the LED 100 is on (first position 108) and when it is off (second position 110). Element 106 includes three divisions 112, 114, and 116. Division 112 represents the light received only from the first position, division 114 is light from the first and second positions 108, 110 and division 116 is light received only from the second position 110. In FIG. 10C, a full DIM pixel is being displayed because the LED 100 is lit only in the first position 108 and not the second position 110. In the following explanation, it is assumed that each pixel of the original image is displayed based on seven contiguous positions of the LED 100. In order to create a DIM pixel the second and sixth positions are lit and to create a medium pixel the second, third, fifth and sixth positions are lit. A BRIGHT pixel is created by lighting the pixel 100 in steps two through six. To separate pixels, in one embodiment, the first and seventh steps are never lit.

With this understanding, FIG. 10C illustrates a full pixel 130 that is produced with the LED 100 being light in the second and sixth positions 142 to form a DIM pixel. For completeness and clarity, the location in time where the LED 100 is shown for all seven possible steps 132-144 are illustrated in FIG. 10C. The LED 100 is not shown in positions 138 and 140 for clarity reasons and is off in those positions.

Figure 10D:
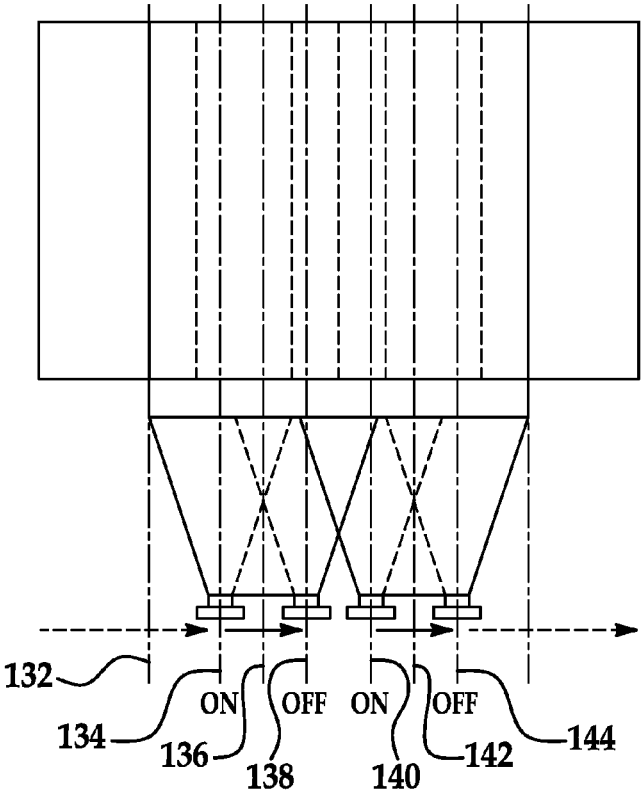

In FIG. 10D, the second 134, third 136, fifth 140 and sixth 142 positions are shown as having the LED 100 to produce a medium pixel 131. In all of FIGS. 10A-10D, the LED 100 is moving from left to right at indicated by the arrow in the sequence of locations 132-144.

To summarize, each pixel includes a first location or pixel boundary defined by step 132. At the second step 134, regardless of the type of pixel (DIM, MEDIUM or BRIGHT), the LED 100 is turned on. At the third step 136, the LED 100 is turned off for DIM pixels and remains on for both MEDIUM and BRIGHT pixels. At the fourth step 138, for DIM and MEDIUM pixels, the LED 100 is off and is only on for BRIGHT pixels. At the fifth step 140, the LED 100 remains off for DIM pixels and is on for MEDIUM and BRIGHT pixels. At the sixth step 142, the LED 100 is lit for all pixel types and the LED 100 is off for all pixel types at the seventh step 144. One of ordinary skill will realize that the seventh step 144 for one pixel is actually the first step for the next pixel. It shall also be understood that the time scale between the steps can varied to suit a particular context.

Referring again to FIG. 8, in one embodiment, the lenses 82 of the lens array 80 are constructed to cooperate with the timing just described. In particular, the lenses may be sized and the timing arranged such that the display 18 includes a specific number (e.g., 128) circumferentially contiguous pixels.

As discussed above, in prior POV displays logical pixel size (i.e., the size of a pixel in the display space) reduces when approaching the center of rotation. However, typically the light sources (LEDs) used in POV displays are all of a fixed size. The result is pixel overlap near the center, which has two negative effects on display quality. The first is related to image distortion because OFF pixels are underneath ON pixels and, as such, are often not "visible." Second, the brightness in the middle of the display is orders of magnitude higher than the outside edge. In one embodiment, this may be overcome by providing a mask element that may cover the lens array shown, for example, in FIG. 8.

Figure 11:
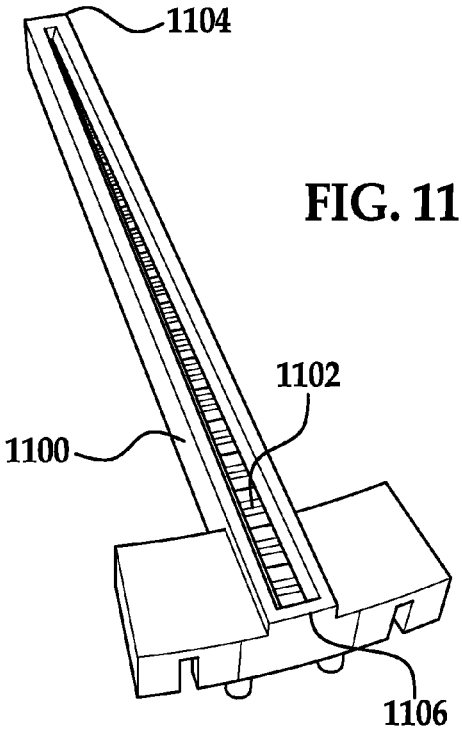
FIG. 11 illustrates a mask element according one embodiment.

FIG. 11 shows a mask element 1100 according to one embodiment. As illustrated, the mask element 1100 is implemented on a single arm rotating assembly. Of course, the configuration of the mask element 1100 could be applied to a double armed rotating assembly that rotates about a center point.

The mask element 1100 of this embodiment includes slit 1102 that increases in width from a first end 1104 to a second end 1106 of the rotating assembly. In this manner, light sources located closer to the center of axis of rotation have more of the light blocked by the mask element 1100 than those closer to an outer edge of the rotating assembly. As such, the mask element may create more even pixel brightness across the display. In addition, the mask element 1100 can also reduce pixel overlap. Another result is that all pixels are nearly contiguous, meaning that the black space between pixels is minimized, for significantly improved image quality. In addition, the combination of the mask element 1100 and the lens array 80 can reduce or elimination of pixel overlap. Such a reduction can reduce the amount of data that needs to be provided to the rotating assembly. Further, by reducing pixel overlap, the contrast ratio of the displayed image can be improved.

Figure 12:
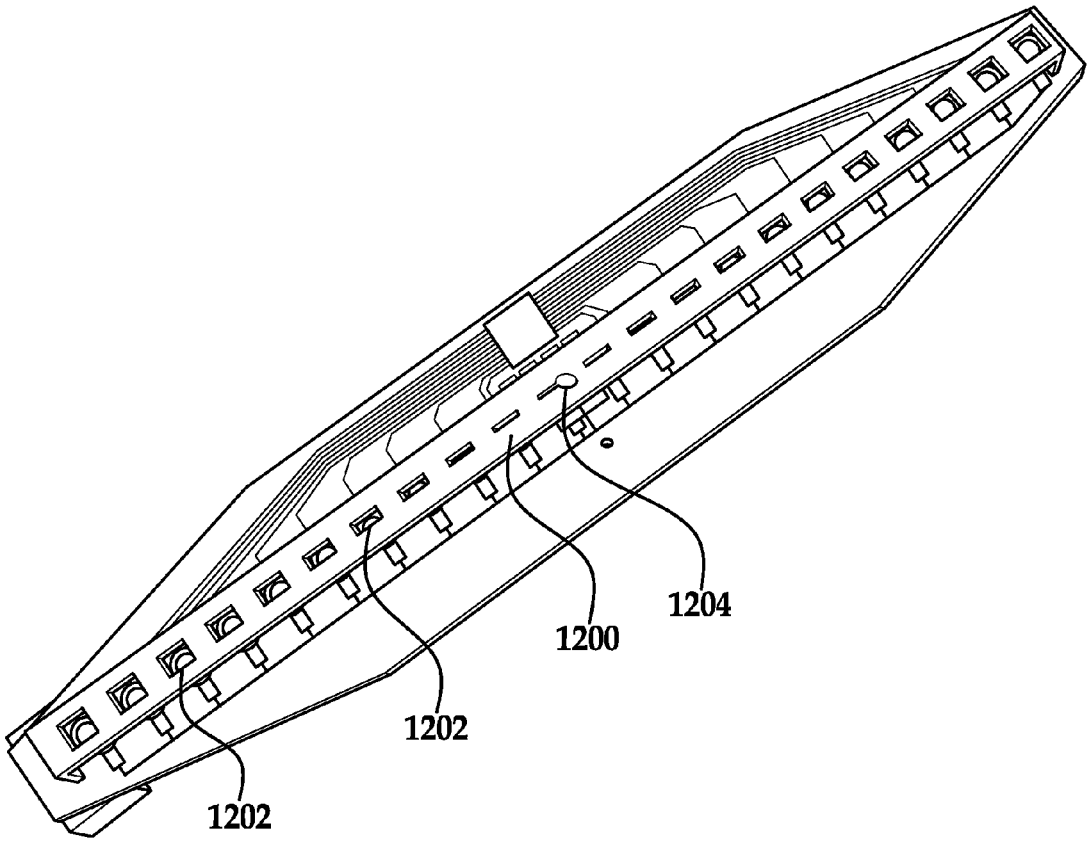
FIG. 12 illustrates a mask element according to another embodiment.

FIG. 12 shows an alternative embodiment of a mask element 1200. The mask element 1200 in this embodiment includes a plurality of holes 1202, each of which was a length and a width. In one embodiment, the length of each hole is the same and the width of each hole increases as the distance between the hole and the center point 1204 increased.

As discussed above, it may be desirable to display greyscale images in POV device. To do so, more than just a "1" or a "0" is required to describe each pixel in the original image. For instance, assume that there are four levels to the greyscale display. This increase will require that twice as much information be transferred to the rotating display. According to one embodiment, a method of reducing the amount of data that needs to be transmitted to the rotating display is disclosed. A review of a prior approach is instructive.

A standard approach to storing, retrieving and displaying radial scan lines converted from an original image includes the pixel values for a particular scan line as a series of bits, packed one after the other into bytes. For a particular POV device having 22 light sources, to implement the two stage pixel scheme described above, a monochrome display would require three bytes to store the monochrome display information or six bytes to store the two-bit grayscale value for each pixel. Each of the six bytes are retrieved in advance of a scan line and then transferred to the rotating display. The six bytes are then written to the port at the four points in time:

1) the start of the scan line (the point at which BRIGHT value pixels turn on);

2) the point at which MEDIUM value pixels turn on;

3) the point at which DIM value pixels turn on; and 4) the point at which all pixels turn OFF.

Figure 13:
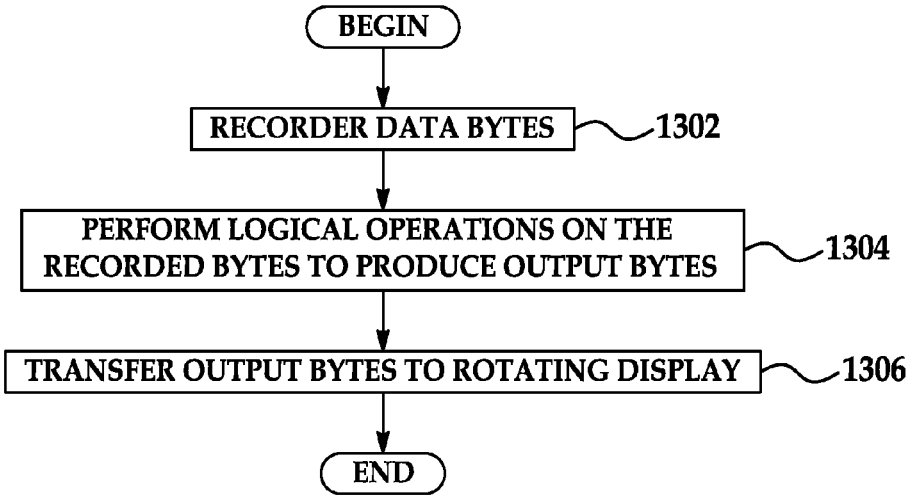
FIG. 13 is a flow chart illustrating a method of formatting data according to one embodiment.

Instead of using this literal approach, and a shown in FIG. 13, embodiments of the present invention are directed to a method where the six raw bytes are transformed before storage and then, on retrieval, these transformed bytes can be used with minimal processing before display. In this explanation, it shall be assumed that there are two communication ports for communicating to the rotating assembly. Further, in this explanation, the raw data (step information) is only 2 bytes long for simplicity but it shall be understood that the raw data could be of any length.

The method illustrated in FIG. 13 begins at block 1300 where the raw data for each step in the display is reordered. This can include breaking each bit pair and storing them in each in one of two bytes.

For example, assume the original scan line for a single port is 11 00 01 01 00 10 11 01. At block 1300 this is transformed to two bytes, 10000110 and 10110011. When these two bytes are stacked, the original bit pairs appear next to each other vertically and are in the correct port order horizontally as shown below:

10000110

10110011

At block 1302, logical operations are performed on the reordered bytes to produce three output bytes. In particular, the first logical operation creates a first output byte that is the BRIGHT+MEDIUM byte. This byte is exactly the same as the first byte shown above. The second output byte is the result of a logical OR of the first and second bytes above and represents the BRIGHT+MEDIUM+DIM bytes. The third output byte is the result of a logical AND of the first and second bytes and represents the BRIGHT value.

At a block 1304, the three output bytes can the transferred to the rotating display for the first half of a pixel.

In the preceding detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. Moreover, repeated usage of the phrase "in an embodiment" does not necessarily refer to the same embodiment, although it may. Lastly, the terms "comprising," "including," "having," and the like, as used in the present application, are intended to be synonymous unless otherwise indicated. This written description uses examples to disclose the invention, including the best mode, and to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An amusement device, comprising:

a rotating assembly display rotatably mounted about a center point configured to create a plurality of images on a display space via a persistence of vision effect caused by light emitted by light sources on the rotating assembly, the images being greyscale and having at least three different states including a BRIGHT state, an OFF state and a DIM state;

a device for rotating the rotating assembly;

a control circuit including a first microcontroller for providing display information to the rotating assembly for creating the images, the display information being based on pixels in a source image wherein each pixel in the source image is displayed according to a plurality of positions of each of the light sources within each pixel of the source image as the rotating display is rotated and wherein at least one of the plurality of positions is a pixel boundary of each pixel and each light source is illuminated or off as they are moved within the plurality of positions and wherein the illumination of each light source depends on the location of each light source as it moves within the plurality of positions of each pixel.

2. The amusement device of claim 1, wherein the plurality of positions includes seven positions and the DIM state is formed by causing a light source to emit light when it is in two of the seven positions and to not emit light when it is in other positions.

3. The amusement device of claim 1, wherein the plurality of positions includes seven positions and the DIM state is formed by causing a light source to emit light when it is in second and sixth positions of the seven positions and to not emit light when it is in other positions.

4. The amusement device of claim 3, wherein the BRIGHT state is formed by causing the light source to emit light when it is in five of the seven positions.

5. The amusement device of claim 3, wherein the BRIGHT state is formed by causing the light source to emit light when it is in second through sixth positions of the seven positions.

6. The amusement device of claim 1, wherein the plurality of positions includes seven positions and the greyscale image also includes a MEDIUM state that is formed by causing the light source to emit light when it is four of the seven positions.

7. The amusement device of claim 1, wherein the plurality of positions includes seven positions and the greyscale image also includes a MEDIUM state that us formed by causing the light source to emit light when it is in second, third, fifth and sixth positions of the seven positions.

8. The amusement device as in claim 1, further comprising a speaker for playing a plurality of sounds, each of the plurality of sound effects corresponding to at least one of the plurality of images.

9. The amusement device of claim 8, wherein the first microcontroller synchronizes the sounds to the plurality of images based on a rate of rotation of the rotating assembly.

10. The amusement device of claim 9, further comprising:

a gating mechanism disposed on a base of the amusement device.

11. The amusement device of claim 10, wherein the rotating assembly further includes:

a sensor having a first portion and a second portion, the first portion arranged on a first side of the gating mechanism and the second portion arranged on a second side of the gating mechanism.

12. The amusement device of claim 11, wherein the gating mechanism is a ring that includes a plurality of teeth and wherein the sensor produces a pulse train as the rotation assembly rotates that is based on times when the sensor passes the teeth.

13. The amusement device of claim 9, wherein the first microcontroller varies power provided to the device for rotating the rotating assembly based on the rate of rotation of the rotating assembly.

14. The amusement device of claim 8, wherein the first microcontroller synchronizes the sounds to the plurality of images based on a time interval.

15. The amusement device of claim 1, wherein the rotating assembly is rotatably mounted about the center point and the rotating assembly includes a plurality of light sources disposed on both side of the center point.

16. The amusement device of claim 1, wherein the rotating assembly is rotatably mounted about the center point and the rotating assembly further comprises a sensor disposed on the rotating assembly at a location closer to an end of the rotating assembly than to the center point and includes a second microcontroller coupled to the sensor that receives communications from the first microcontroller through the sensor.

17. The amusement device of claim 16, wherein the rotating assembly includes a plurality of light sources and the first microcontroller and the second microcontroller control operation of the plurality of light sources based on the received communications.

18. The amusement device of claim 1, wherein the rotating assembly is disposed within a belt.

19. The amusement device of claim 18, wherein the belt is a championship belt.

20. The amusement device of claim 1, wherein the rotating assembly includes a plurality of light sources and further comprising:

a lens array disposed on the rotating assembly that creates a rectilinear light pattern from light emitted by the light sources.

21. The amusement device of claim 20, further comprising: a mask element disposed over the lens array.

22. The amusement device of claim 21, wherein the mask element includes a slot that has an expanding width along its length.

23. The amusement device of claim 1, wherein the rotating assembly includes a plurality of light sources and further comprising:

a mask element disposed on the rotating assembly over at least one of the light sources.

24. The amusement device of claim 23, wherein the mask element includes a slot that has an expanding width along its length.

25. The amusement device as in claim 1, further comprising: a buckle portion; and fasteners for securing the buckle portion to a user; wherein the buckle portion includes:

the rotating assembly display and wherein the rotating assembly display is rotatably mounted about a center point;

the device for rotating the rotating assembly; and the control circuit including the first microcontroller in operable communication with a sensor disposed on the rotating assembly, the first microcontroller controlling a speed at which the device for rotating the rotating assembly rotates the rotating assembly based on communications with the sensor.

26. The amusement device of claim 25, wherein the sensor is located at a location closer to an end of the rotating assembly than to the center point.

27. The amusement device of claim 25, wherein the buckle portion is formed to resemble a title belt.

28. The amusement device of claim 25, wherein the rotating assembly includes a plurality of light sources disposed on both sides of the center point.

29. The amusement device of claim 25, wherein the rotating assembly includes a second microcontroller coupled to the sensor that receives communications from the first microcontroller through the sensor.

30. The amusement device of claim 29, wherein the rotating assembly includes a plurality of light sources and the first microcontroller and the second microcontroller control operation of the plurality of light sources based on the received communications.

31. The amusement device of claim 1, further comprising a mask element for varying the amount of light transmitted by each of the plurality of light sources, wherein the mask element has a plurality of openings each being aligned with one of the light sources and each having a length and a width, wherein the length of each opening is the same and the width of each opening increases as the distance between the opening and the center point increases.

* * * * *